US011859632B2

(12) United States Patent
Bowman et al.

(10) Patent No.: US 11,859,632 B2
(45) Date of Patent: Jan. 2, 2024

(54) BOUNDARY-LAYER PUMP AND METHOD OF USE

(71) Applicants: John Lloyd Bowman, New Orleans, LA (US); Ricky Jay Jackson, Williamston, MI (US); Bryan Patrick Killeen, New Orleans, LA (US)

(72) Inventors: John Lloyd Bowman, New Orleans, LA (US); Ricky Jay Jackson, Williamston, MI (US); Bryan Patrick Killeen, New Orleans, LA (US)

( * ) Notice: Subject to any disclaimer, the term of this patent is extended or adjusted under 35 U.S.C. 154(b) by 53 days.

(21) Appl. No.: 17/627,841

(22) PCT Filed: Sep. 10, 2021

(86) PCT No.: PCT/US2021/049884
§ 371 (c)(1),
(2) Date: Jan. 18, 2022

(87) PCT Pub. No.: WO2022/098428
PCT Pub. Date: May 12, 2022

(65) Prior Publication Data

US 2023/0116851 A1 Apr. 13, 2023

Related U.S. Application Data

(60) Provisional application No. 63/109,494, filed on Nov. 4, 2020.

(51) Int. Cl.
*F04D 29/18* (2006.01)
*F04D 5/00* (2006.01)

(52) U.S. Cl.
CPC ..... *F04D 29/185* (2013.01); *F04D 5/001* (2013.01); *F04D 29/181* (2013.01)

(58) Field of Classification Search
CPC ..... F04D 1/02; F04D 1/06; F04D 3/02; F04D 15/0094; F04D 29/181; F04D 29/185
See application file for complete search history.

(56) References Cited

U.S. PATENT DOCUMENTS 3,697,190 A 10/1972 Haentjens
5,312,224 A 5/1994 Batchelder et al.
(Continued)

FOREIGN PATENT DOCUMENTS

CH 677254 4/1991
CN 208060348 U 11/2018

OTHER PUBLICATIONS

PCT/US2021/049884 International Search report dated Dec. 20, 2021.

*Primary Examiner* — Juan G Flores
*Assistant Examiner* — Jason G Davis
(74) *Attorney, Agent, or Firm* — Veritay Group IP, PLLC; Susan Fentress

(57) ABSTRACT

A device for pumping fluid such as paints, sealants, caulks, and polymers made of a rotor assembly and a pump body. The rotor assembly contains at least one laminar flow element arranged in such a manner as to conduct the fluid from inlet to outlet as the rotor spins. The rotor may vary its distance from the pump body. This arrangement provides a rotor with exceptional capacity to pump without damage to the fluid media and to measure the fluid rate at low or high rotational speed with viscosity that can vary. The device also may provide a spray nozzle or nozzles that produce a multiplicity of spray patterns.

10 Claims, 8 Drawing Sheets

(56) References Cited

U.S. PATENT DOCUMENTS

| | | | | |
|---|---|---|---|---|
| 6,367,247 | B1 * | 4/2002 | Yancey | F01B 17/02 415/73 |
| 7,341,424 | B2 * | 3/2008 | Dial | F04D 29/2238 415/90 |
| 9,295,336 | B2 * | 3/2016 | Driscoll, Jr. | F04D 17/161 |
| 10,947,992 | B2 * | 3/2021 | Sarmiento | F04D 29/42 |
| 2010/0158672 | A1 | 6/2010 | Helmer et al. | |
| 2011/0305589 | A1 | 12/2011 | Daunheimer | |

* cited by examiner

BOUNDARY-LAYER PUMP AND METHOD OF USE

CROSS REFERENCE TO RELATED APPLICATIONS

This application is a 371 of international prior application no. PCT/US21/49884 filed Sep. 10, 2021. PCT/US21/49884 is a nonprovisional patent application, claiming the benefit of U.S. application No. 63/109,494 filed Nov. 4, 2020, under 35 U.S.C. Sec. 119(e) (hereby incorporated by reference in their entirety).

STATEMENT REGARDING FEDERALLY SPONSORED RESEARCH OR DEVELOPMENT

None.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE OF THE MATERIAL ON THE COMPACT DISC

None.

FIELD OF THE INVENTION

This invention relates to a boundary-layer pump and its use to pump varying viscosities without clogging and that will precisely meter fluid media.

BACKGROUND OF THE INVENTION

Description of the related art including information disclosed under 37 CFR 1.97 and 37 CFR 1.98. In the field of fluid pumps there are a variety of designs. Perhaps the oldest and most famous design is the Archimedes screw. This design uses a helical surface mounted on a rotary axis to move fluid through a pipe. It is the most efficient means of moving high volumes of fluid at low pressure and is still used in municipal pumping stations throughout the world.

Since Ancient Greece, other pumps have evolved. The gear pump was invented in 1593 and uses two meshing gears to move fluid in a confined cavity. Pumps invented in the 1600s include the centrifugal pump which uses rotating vanes and centrifugal force to pull fluid from an axial inlet to a peripheral outlet, and the piston pump which uses a reciprocating piston to move fluid through inlet and outlet valves. Pumps invented in the 1900s include the peristaltic pump which uses a rotating set of rollers to push fluid through a collapsible tube, and the diaphragm pump which uses a flexible membrane to create a cavity of varying internal volume similar to the piston pump. There are many variations on each of these pumps and several exotic types of pump. One example of an exotic pump is the multi-stage centrifugal, which feeds the output of one centrifugal pump to the inlet of another, thus increasing total pressure.

Every pump has advantages and disadvantages which make it most suitable for a particular application or media. Of particular interest in the present case are the fluids of high viscosity, which include machine oils, crude oils, petroleum, paints, protective coatings, additives, dyes, glues, sealants, caulks, slurries, resins, soaps, polishes, syrups, vegetable oils, fruit and vegetable pastes, dairy products, medicines, cosmetics, and many others.

Taking paint as a specific example, we can examine the needs of industry. In industrial/commercial applications, paint must be supplied to a spray head at high, uninterrupted pressure. Variations in pressure can alter the volume of paint delivered through a nozzle and thus produce inconsistencies in the thickness and quality of the deposited media. Therefore, it is of critical importance that pressure and flow should be precisely metered. Advanced paints have additives, such as metal flakes, that are expensive and functionally important, and which may be damaged by crushing points such as those in gear pumps and gear meters.

In another example, two-part resins are used in high-performance coatings and as a solidifying agent in fiberglass fabrication. Peristaltic pumps are often chosen as the dosing pump for these applications, but inevitably the rubber hoses used in these pumps degrade over time and must be replaced.

This novel subject matter provides a pump that will not damage fluid additives, that will work in high- and low-pressure conditions, solving a long existing technical problem.

BRIEF SUMMARY OF THE INVENTION

We introduce herein a pump whose rotor is constructed with at least one continuous helical or spiraling feature(s) or channel(s) that when rotating inside of the stator/housing moves fluid media in less-than-turbulent and mostly laminar flow. Although this pump shares the simplicity of centrifugal pumps, it abandons centrifugal force as the primary motive force and instead uses boundary-layer effects to move the media and to develop high pressures. Unlike a centrifugal pump, this pump is reversible in flow direction. The rotor within the stator may have one or more bearings and shaft seals. An adjustment cap may allow for a controlled, variable separation of the rotor from the fixed stator. This eliminates the crush potential of media additives, like particles, or in the case of highly viscous media, constriction inhibiting a desired flow. The bearing may be a thrust bearing which allows the rotor to operate against extreme pressure without seizing against the adjustment cap.

The inventive subject matter includes a boundary-layer pump made of: a pump body configured to receive a rotor assembly. The rotor assembly is made of an input shaft configured to rotate the rotor assembly and a laminar fluid flow chamber. The pump body has a proximal end and a distal end, an at least one primary inlet port and an at least one primary outlet port.

The inventive subject matter further includes a method to determine flow rate of a fluid including the steps of: providing the boundary-layer pump; rotating the rotor assembly; counting the number of rotations of the rotor assembly and determining the flow rate of a fluid. However, the boundary-layer pump can be used to make more precise determination of volumetric and mass flow rate of the fluid by: detecting pressure at first absolute pressure sensor; detecting pressure at second absolute pressure sensor, wherein laminar flow is maintained between the first and second sensor; detecting temperature and determining precise volumetric and mass flow rates of the fluid.

BRIEF DESCRIPTION OF THE SEVERAL VIEWS OF THE DRAWING

The accompanying figures, which are incorporated in and constitute a part of this specification, illustrate several aspects and together with the description serve to explain the principles of the invention.

DETAILED DESCRIPTION OF THE INVENTION

Figure 1:
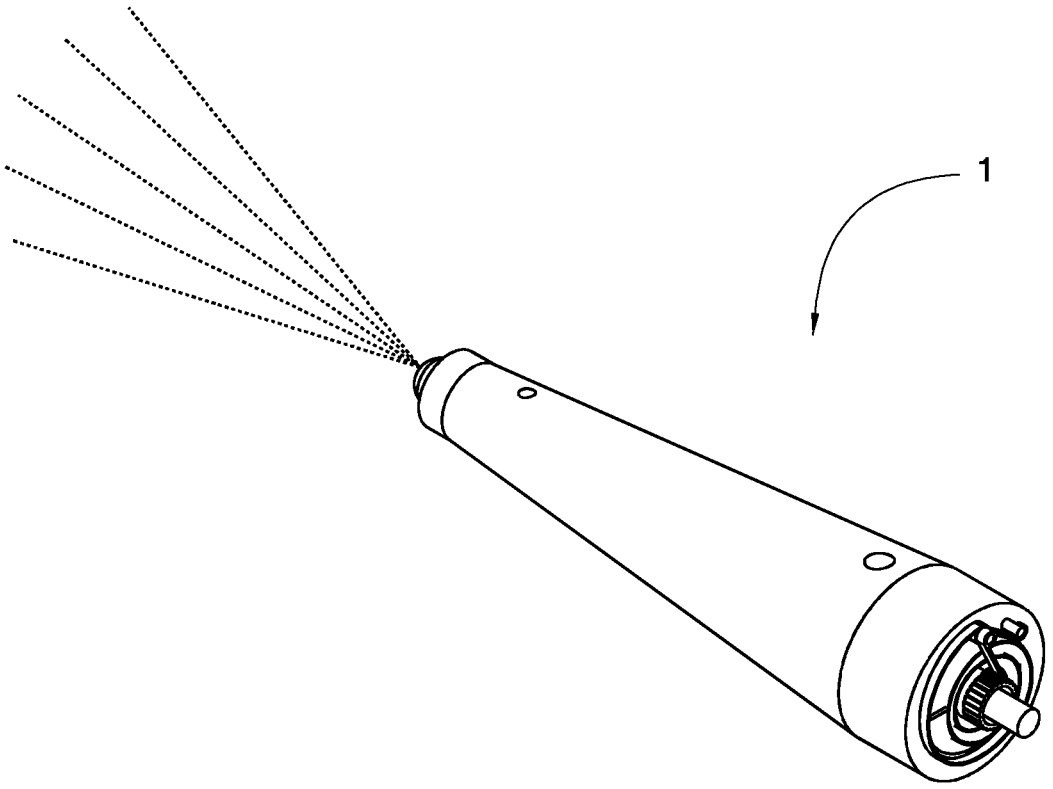
FIG. 1 is a view of a boundary-layer pump apparatus of the present invention.

The present invention can be understood more readily by reference to the following detailed description of the invention and the Examples included therein. Before the present compounds, compositions, articles, systems, devices, and/or methods are disclosed and described, it is to be understood that they are not limited to specific synthetic methods unless otherwise specified, or to particular reagents unless otherwise specified, as such may, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

In the following descriptions, like reference characters designate like or corresponding parts throughout the several views and embodiments. Also, it is to be understood that such terms as "forward," "rearward," "left," "right," "upwardly," "downwardly," and the like are words of convenience and are not to be construed as limiting terms. Locations, shapes, sizes, materials, numbers, relative positions, angular positions, velocities of motion, ranges of motion, electrical tolerances, mechanical tolerances, and other such properties of the devices within the embodiments may be altered and are not to be construed as limiting factors. Nor should the components comprising an assembly be construed as the only suggested components within that assembly. Referring now to the drawings, it will be understood that the illustrations are for the purpose of describing embodiments of the invention and are not intended to limit the invention thereto.

Now referring to FIG. 1 shows the boundary-layer pump 1 dispersing a spray. A boundary-layer pump 1 is a pump in which greater than 20% of the motive force acting upon the fluid is derived from friction between the fluid and a surface of the pump. The boundary-layer pump 1 of this invention is also a continuous-flow pump. A continuous-flow pump is any pump in which the fluid flow path from inlet port to outlet port is uninterrupted by any valve, vane, tooth, lobe, or other obstruction.

Figure 2:
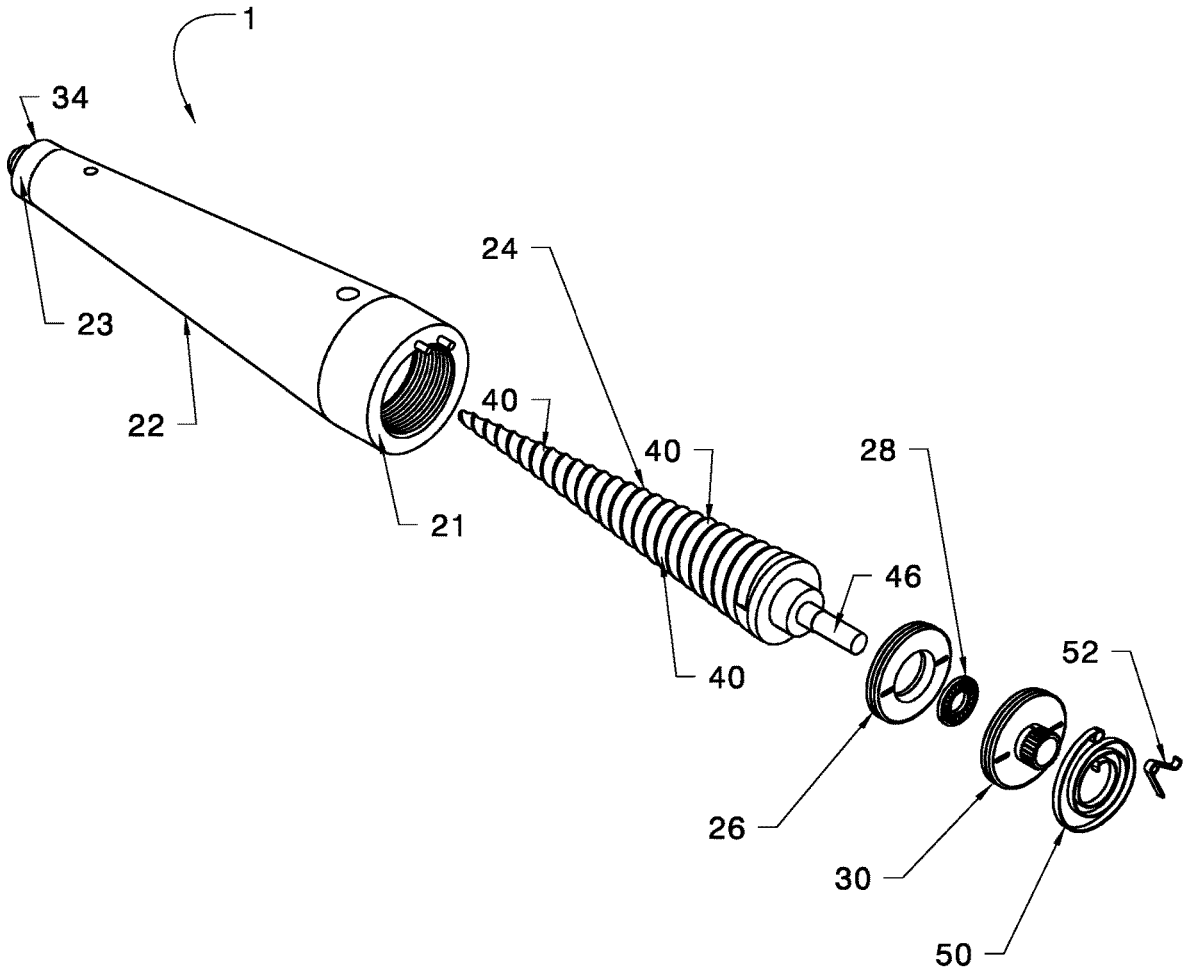
FIG. 2 is an exploded front perspective view of a first embodiment of the present invention.
Figure 3:
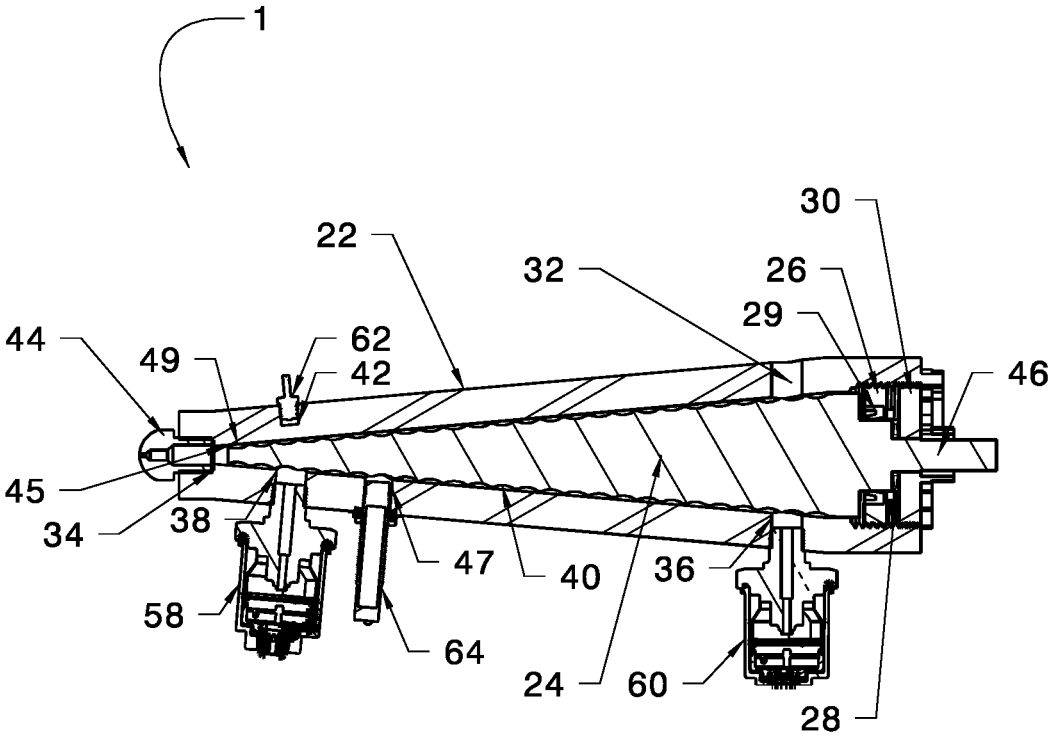
FIG. 3 is a side section view of a first embodiment of the present invention.

Now referring to FIGS. 2-3 is a view of a first embodiment of the boundary-layer pump 1. The view shows a pump body 22. The pump body 22 is a stationary part of a boundary-layer pump 1. In this embodiment, the pump body 22 is generally tapered in shape with the wider end proximal 21 to the input shaft 46 and the narrower end distal 23 to the input shaft 46. The pump body 22 is configured to receive a rotor assembly 24. In this embodiment, the rotor assembly 24 is shown as a screw rotor.

The rotor assembly 24 includes a laminar fluid flow channel 40. A laminar fluid flow channel 40 provides non-turbulent flow for a particular fluid by restricting the depth of the laminar fluid flow channel 40, such that no portion of the fluid flow is outside of the boundary-layer. The laminar fluid flow channel 40 in the rotor assembly 24 is configured to enable flow toward the outlet port 34 while maintaining a Reynolds number (Re) which is preferably below 2000. This measure depends on the particular fluid viscosity and the RPM of the pump in addition to the channel depth. In practice, these practical considerations result in a channel with a width-to-depth ratio generally greater than 5:1. The laminar fluid flow channel 40 is of less than the maximum width and depth necessary to maintain the laminar flow of its intended fluid, which may include machine oils, petroleum, crude oils, paints, protective coatings, additives, dyes, glues, sealants, caulks, slurries, resins, soaps, polishes, syrups, vegetable oils, fruit and vegetable pastes, dairy products, medicines, cosmetics, and many others. The laminar channel 40 shown here has a tapered helix configuration. However, the laminar channel 40 can also have a helix, or spiral configuration.

The length of the laminar fluid flow channel 40 determines the general head pressure capacity of the boundary-layer pump 1. An increased pressure capacity is often a desirable advantage over other pumps and begins to manifest approximately when the laminar fluid flow channel 40 length is greater than 2× the radius of the rotor assembly 24 or greater than five times the square root of the channel's cross-sectional area. The rotor assembly 24 rotates by means of an input shaft 46. The input shaft 46 is a central rotating member of boundary-layer pump 1 driven by a conventional motor (not shown).

The input shaft 46 is sealed by a shaft seal 29, a seal cap 26, a bearing 28 and an adjustment cap 30. The shaft seal 29 and seal cap 26 retains the fluid within the pump body 22. The boundary-layer pump 1 includes an adjustable gap 45 between rotor assembly 24 and pump body 22. The adjustment cap 30 includes a threaded outside diameter which mates with a threaded inside diameter of the pump body 22. By screwing or unscrewing the cap, the gap 45 between the rotor assembly 24 and the opposing wall 49 of the pump body is made variable. The adjustment cap 30 and bearing 28 may retract from the rotor assembly 24 when fluid has high viscosity or additive particles.

At least one primary inlet port 32 and an at least one primary outlet port 34 is provided in the pump body 22. A spray nozzle 44 is connected to the distal end of the boundary-layer pump 1. A spray nozzle 44 is a precision device that facilitates dispersion of liquid into a spray.

The boundary-layer pump 1 further includes a number of ports for sensors. These sensors include: a low-pressure sensor 60 and low-pressure sensor port 36, a high-pressure sensor 58 and high-pressure sensor port 38, a thermocouple 62 and thermocouple port 42, and a sensor port 47 for any sensor 64 of: temperature, RPM, flow rate, x-rays, ultraviolet, visible light, infrared, video inspection, viscosity, dielectric, or conductivity.

Preferred materials of construction of the pump body 22 and rotor assembly 24 may include hardened stainless steel, hardened tool steel, nitronic, PTFE, or polymer-ceramic, although any suitable material may be used.

Boundary-layer pump 1 operates by continuously drawing fluid into the at least one primary inlet port 32, by the rotation of an input shaft 46. The fluid is pumped by the rotor assembly 24 towards the outlet port 34. A continuous-flow pump is a pump in which the fluid flow path 48 (FIG. 7) from at least one primary inlet port 32 to at least one primary outlet port 34 is uninterrupted by any valve, vane, tooth, lobe, or other obstruction. The fluid occupies a laminar fluid flow channel 40 within the rotor that is sufficiently shallow as to maintain non-turbulent fluid flow and boundary layer effect. A boundary-layer pump 1 is any pump having at least one boundary-layer surface which imparts greater than 20% of the kinetic energy to a fluid by means of friction between the boundary-layer surface and the fluid.

The laminar fluid flow channel 40 has a defined cross-sectional area and thus the rotational velocity of the rotor assembly 24 provides precise volume flow metering. Additionally, the placement of an absolute pressure sensor at the low-pressure port 36 and high-pressure port 38 along with a thermocouple at the thermocouple port 42 provides precision mass flow metering, in accordance with Bernoulli's Principle. The variable screw or spiral, while turning, is a pump that is also a precise flow meter. This precision is derived from the extended path length of the fluid against the rotor, which effectively couples the fluid to the rotor and prevents fluid slippage. The pulsation-free, laminar flow is highly uniform from one time interval to the next, even into the millisecond range. The differential pressure between the inlet and outlet ports, the known cross-sectional area of the laminar channel, and the known velocity of the media demonstrate Bernoulli's Principal for flow rate. Pressure ports may be located through the stator walls over the laminar channel. The pressure may be measured by an absolute pressure sensor in an ideal, low-turbulent region affording accuracy and precision of measurement. Further, a temperature sensor may allow for conversion of the volumetric flow information to mass flow information. Multiple orifice or nozzle types built onto or added to the outlet port of the pump may dispense the media in different flow or 'spray' patterns. Adjustment of RPM and of outlet orifices can establish the ideal flow and pressure combination for a particular application.

The boundary-layer pump 1 can include a spring-loaded or ratcheting auto-tensioner 50 & 52 to compensate for surface wear.

Figure 4:
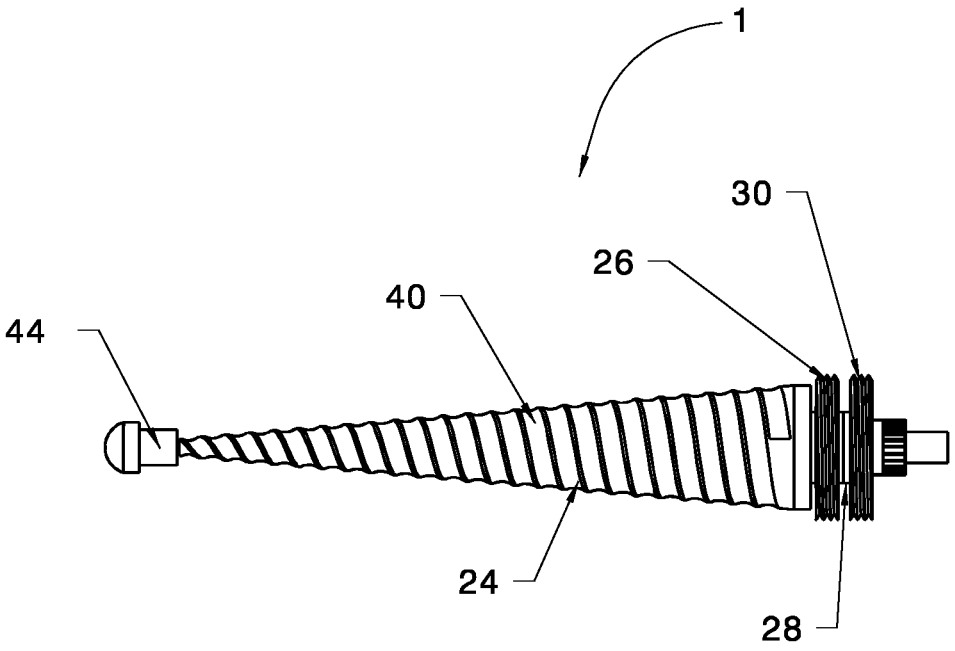
FIG. 4 is a side view of the rotor, nozzle, adjustment cap and seal cap.

Now referring to FIG. 4 is a side view of a first embodiment of the boundary-layer pump 1. The view includes a rotor assembly 24, an adjustment cap 30, thrust bearing 28, seal cap 26, and a laminar fluid flow channel 40. This laminar fluid flow channel 40 in the rotor assembly 24 enables flow toward a nozzle 44 while providing smooth fluid alignment. Any spray nozzle 44 for a particular application can be attached to the boundary-layer pump 1.

Figure 5:
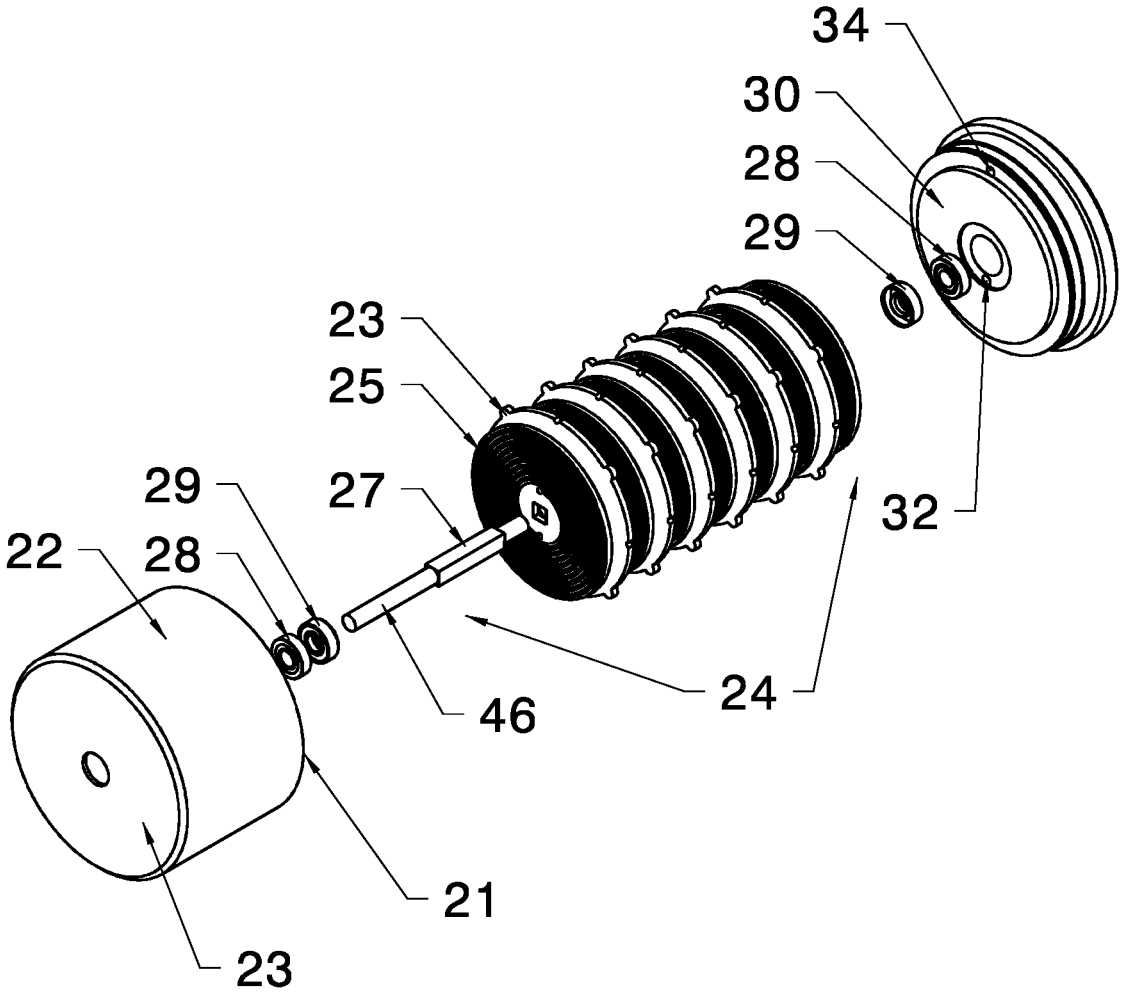
FIG. 5 is an exploded front perspective view of a second embodiment of the present invention.
Figure 6:
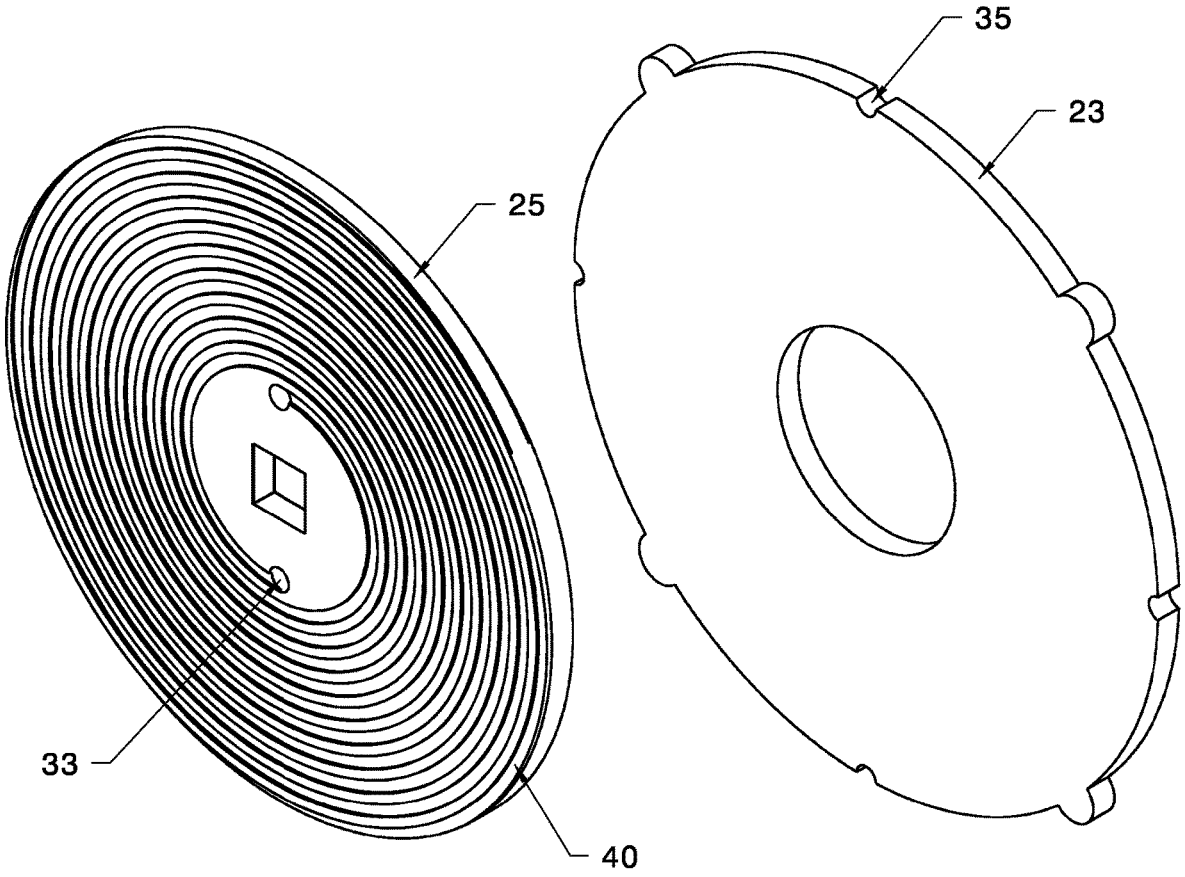
FIG. 6 is a detailed front perspective view of the rotor disc and stator disc of FIG. 5
Figure 7:
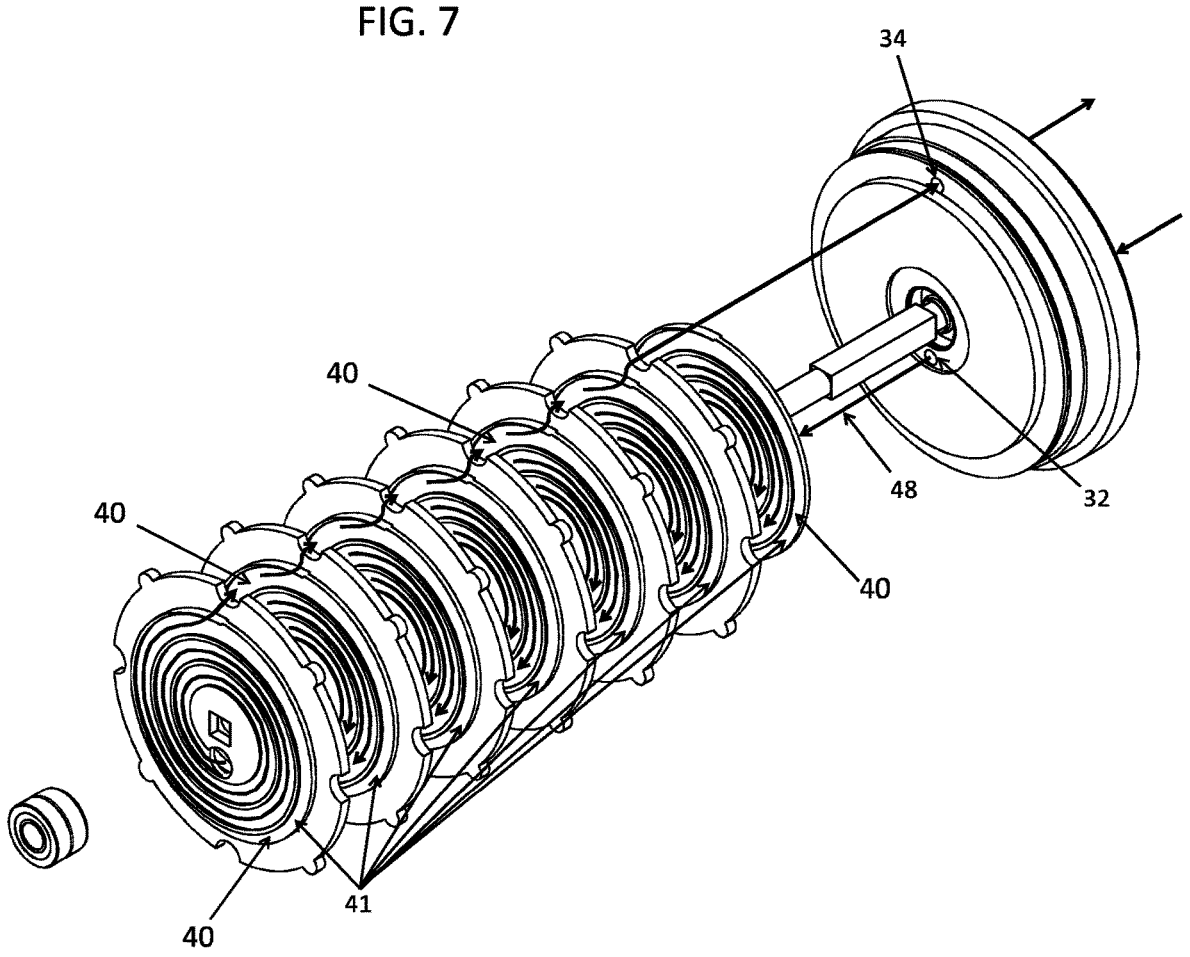
FIG. 7 is an exploded front perspective of the disc stack illustrating the fluid flow vectors.

Now referring to FIGS. 5-7, a second embodiment of the boundary-layer pump 1 is shown. In this embodiment, a rotor assembly 24 is made of a plurality of rotor discs 25 on a common shaft-type rotor 27. Each of the rotor discs 25 is alternately positioned between a corresponding plurality of stator discs 23, with the stator discs 23 rendered incapable of rotation by their coupling to a pump body 22. In this exemplary embodiment, each rotor disc has at least one laminar fluid flow channel 40 arranged in the general form of an Archimedean spiral. The plurality of rotor discs 25 are organized in a stack. The stack is a coaxial alternating arrangement of rotor discs 25 and stator discs 23, which when arranged in parallel flow does increase the effective cross-sectional area of laminar fluid flow channel 40, and when arranged in series increases the effective length of laminar fluid flow channel 40, without sacrificing the boundary layer effects on the fluid.

On each end of the rotor 27 is a bearing 28 and shaft seal 29, which allow free rotation of the rotor assembly 24 and prevent fluid from leaking out of the boundary-layer pump 1, respectively. In an adjustment cap 30, an at least one primary inlet port 32 and an at least one outlet port 34, provides the primary ingress and egress of fluid to the boundary-layer pump 1. Fluid flow is communicated from the at least one primary inlet port 32 through the laminar fluid flow channel 40 before recombining and exiting through the outlet port 34.

In this embodiment, the laminar fluid flow channel 40 comprises at least one secondary inlet port 33 positioned on each of the rotor discs 25, said at least one secondary inlet port 33 configured to allow fluid communication to the plurality of rotor discs 25. An at least one secondary outlet port 35 is positioned on each of the stator discs 23 configured to allow fluid communication to the at least one primary outlet port 34. More specifically, the rotor discs 25 comprise a set of at least one axial secondary inlet port 33 that allows fluid communication to a plurality of rotor discs 25, with all rotor discs 25 producing flow in parallel through at least one laminar fluid flow channel 40. The flows exit each disc of the plurality of rotor discs 25 at the periphery and may combine to pass through at least one secondary outlet port 35.

In this embodiment, the fluid flow is communicated from the at least one primary inlet port 32 through the secondary inlet ports 33 of each rotor disc 25, and in parallel through the laminar fluid flow channel 40 of each rotor disc 35, before recombining and exiting through the secondary outlet port 35 and at least one primary outlet port 34.

Figure 8:
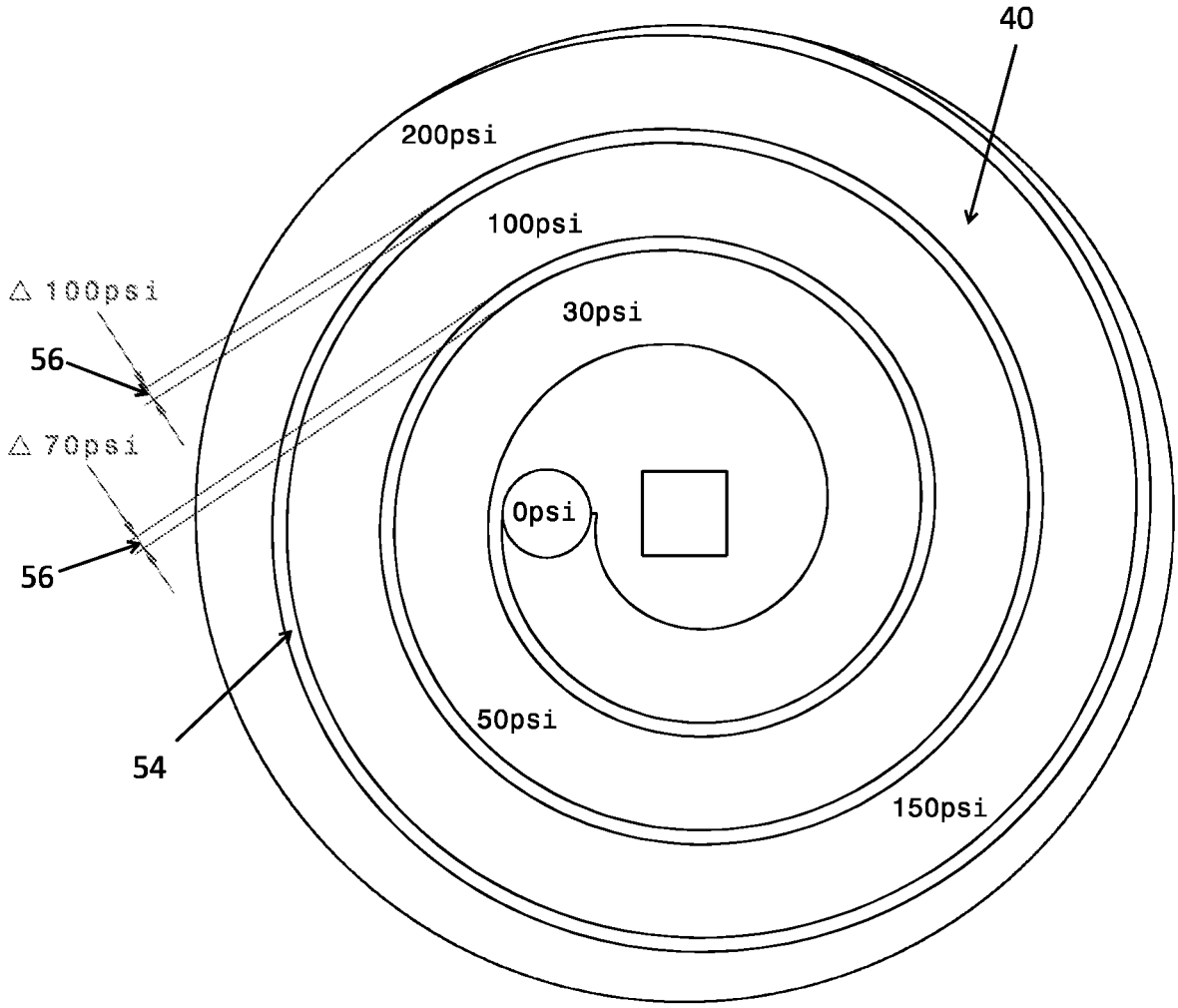
FIG. 8 is a front schematic view of the rotor disc, illustrating absolute and differential pressures.

Now referring to FIG. 8 is a front schematic view of a rotor disc 25 illustrating absolute and differential pressures. For an example, absolute pressure of 200 psi, fluid increases from 0 psi in a substantially linear fashion throughout the length of the channel. A pressure differential develops between subsequent turns of the laminar fluid flow channel 40, and the channel face seal 54 of the rotor must endure this delta pressure 56.

Boundary-layer pump 1 operates by continuously drawing fluid into the at least one primary inlet port 32 by the rotation of an input shaft 46. The fluid is pumped by the rotor assembly 24 towards the outlet port 34. A continuous-flow pump is a pump in which the fluid flow path 48 (FIG. 7) from at least one primary inlet port 32 to outlet port 34 is uninterrupted by any valve, vane, tooth, lobe, or other obstruction. The fluid occupies a laminar fluid flow channel 40 within the rotor that is sufficiently shallow as to maintain non-turbulent fluid flow and boundary-layer effect. A boundary-layer pump is any pump having at least one boundary-layer surface which imparts greater than 20% of the kinetic energy to a fluid by means of friction between the boundary-layer surface and the fluid. An adjustment cap 30 and bearing 28 may retract from the rotor when fluid has high viscosity or additive particles. A shaft seal 29 or seal cap 26 retains the fluid within the pump body 22.

The at least two embodiments of the present invention provide a unique, variable, laminar-channel rotor nesting in a stator that can be tightened or loosened from the stator, changing the effective cross-sectional area of the channel interface. The pump maintains low Reynold's numbers in the rotor channel thus also being a precision fluid volume and mass flow meter that is comparably simple to manufacture. Materials being pumped are not damaged by pumping action.

Many other variations are possible. For example: although the embodiments illustrate particular geometries of the outlet port and associated spray nozzle, any configuration of outlets or spray nozzles can be used. The inlet or outlet may include a check valve or other valve type. Although the embodiments illustrate particular geometries for helical or spiraling laminar channels, any number, shape, proportion, or cross-sectional area may be used, providing laminar or non-laminar flow. Although the embodiments illustrate a laminar channel upon a rotor, the laminar channel may alternately or additionally be upon the stator. Although the embodiments illustrate particular geometries of adjustment cap, the variable channel cross-sectional area adjustment can be performed by any other means, such as a channel shim or channel spring. The adjustment feature may include a spring-loaded or ratcheting auto-tensioner to compensate for wear. The adjustment feature may be removed altogether and the gap distance may be fixed. Although the embodiments suggest rotor and stator materials of hardened stainless steel, any suitable material, including but not limited to tool steel, other metals, ceramic, glass, plastic, synthetic, or composite, may be used. Materials such as Nitrolic, PTFE, carbon fiber, Kevlar, and polymer-ceramic composite are of particular interest. Soft-sealing materials such as rubber, neoprene, silicone, and the like may be used at any sealing surface. Although the embodiments show thrust bearings and ball bearings on the rotor, other types of bearing may be used, including but not limited to bushings, journal bearings, tapered roller bearings, pressurized bushings, gas bearings, and magnetic suspension bearings. Although an embodiment shows a stack of rotor discs operating in parallel, they may be arranged to operate in series. Although the embodiments show a spiral channel upon a conical and disc rotor respectively, the channel may be upon a rotor of any shape, including but not limited to cylindrical, spherical, hyperbolic, or organic. Although the embodiments show rotors of substantially unitary construction, the rotors may include at least one clutch, allowing a variable number of rotor discs or segments to engage at a time. Although the embodiments show rotors within a single housing, the rotors may be contained within two or more housings, and upon a common drive shaft, such that they may pump a two-part resin or other formulaic mixture of fluids. Although the embodiments show accommodations for pressure sensors and thermocouples, these accommodations may be extended to include any variety of sensor, including but not limited to RPM, flow rate, x-rays, ultra-violet, visible light, infrared, video inspection, viscosity, dielectric, conductivity, and others.

While the invention has been described with reference to details of the illustrated embodiments, these details are not intended to limit the scope of the invention as defined in the appended claims. The embodiment of the invention in which exclusive property or privilege is claimed is defined as follows.

We claim:

1. A boundary-layer pump comprising: a pump body (22) configured to receive a rotor assembly (24), said rotor assembly comprised of an input shaft (46) configured to rotate the rotor assembly (24) and a laminar fluid flow channel (40), wherein said pump body (22) has a proximal end (21) proximal to the input shaft (46) and a distal end (23) distal to the input shaft (46), at least one primary inlet port (32) and at least one primary outlet port (34) and an adjustment cap (30), said adjustment cap (30) comprised of a threaded outside diameter which is configured to mate with a threaded inside diameter of the pump body (22).

2. The boundary-layer pump of claim 1, further comprising a spray nozzle (44) in fluid communication with the at least one primary outlet port (34).

3. The boundary-layer pump of claim 1, further comprising a sensor selected from the group consisting of: pressure, temperature, RPM, flow rate, x-rays, ultra-violet, visible light, infrared, video inspection, viscosity, dielectric, and conductivity.

4. The boundary-layer pump of claim 1, wherein the laminar fluid flow channel (40) is of less than a maximum width and depth necessary to maintain the laminar flow of an intended fluid.

5. The boundary-layer pump of claim 1, wherein the rotor assembly (24) is comprised of a screw rotor.

6. The boundary-layer pump of claim 5, wherein the rotor assembly (24), is the screw rotor comprised of a configuration selected from the group consisting of: a spiral, a helix, and a tapered helix shape.

7. The boundary-layer pump of claim 1, wherein the laminar fluid flow channel (40) length is greater than two times a radius of the rotor assembly (24).

8. The boundary-layer pump of claim 1, wherein the laminar fluid flow channel (40) has a cross-sectional width-to-depth ratio greater than 5:1 and a length greater than five times the square root of its cross-sectional area.

9. The boundary-layer pump of claim 1, wherein said adjustment cap (30) is configured to adjust a gap between an opposing wall of the pump body and the adjustment cap.

10. A boundary-layer pump comprising: a pump body (22) configured to receive a rotor assembly (24), said rotor assembly comprised of an input shaft (46) configured to rotate the rotor assembly (24) and a laminar fluid flow channel (40), wherein said pump body (22) has an end (21) proximal to the input shaft (46) and an end (23) distal to the input shaft (46) at least one primary inlet port and at least one primary outlet port (34) wherein the rotor assembly (24) is comprised of a plurality of rotor discs positioned on a shaft-type rotor (27) wherein each of the rotor discs (25) are alternately positioned between a corresponding stator disc, said stator disc (23) coupled to the pump body wherein said laminar fluid flow channel (40) is comprised of at least one secondary inlet port (33) positioned on each of the rotor discs (25,) said at least one secondary inlet port (33) configured to allow fluid communication to the plurality of rotor discs (25), at least one secondary outlet port (35)

positioned on each of the rotor discs (25) configured to allow fluid communication to the at least one primary outlet port (34).

* * * * *